US006863606B1

(12) United States Patent
Berg et al.

(10) Patent No.: US 6,863,606 B1
(45) Date of Patent: Mar. 8, 2005

(54) METHOD OF PLAYING A GAME INVOLVING QUESTIONS AND ANSWERS

(76) Inventors: Charles R. Berg, 1150 Pointe Hope Landing, San Jose, CA (US) 95131; Kathleen C. Bolich, 2284 Boxwood Dr., San Jose, CA (US) 95128; Scott A. Caputo, 2101 California St., #309, Mountain View, CA (US) 94040; Stacy A. Friedman, 1139 Amarillo Ave., #1, Palo Alto, CA (US) 94303; Nathan G. Leland, 2336 Steiner St., #11, San Francisco, CA (US) 94115

( * ) Notice: Subject to any disclaimer, the term of this patent is extended or adjusted under 35 U.S.C. 154(b) by 448 days.

(21) Appl. No.: 09/583,321

(22) Filed: May 30, 2000

(51) Int. Cl.[7] ..... A63F 9/22
(52) U.S. Cl. ..... 463/16; 463/20
(58) Field of Search ..... 463/16, 20, 25

(56) References Cited

U.S. PATENT DOCUMENTS 4,372,554 A * 2/1983 Orenstein ..... 273/237
4,593,904 A * 6/1986 Graves ..... 434/323
5,213,337 A * 5/1993 Sherman ..... 463/42
6,193,606 B1 * 2/2001 Walker et al. ..... 463/20
6,302,790 B1 * 10/2001 Brossard ..... 463/20
6,364,767 B1 * 4/2002 Brossard ..... 463/20
6,390,473 B1 * 5/2002 Vancura et al. ..... 273/292
6,394,899 B1 * 5/2002 Walker ..... 463/9
2001/0038178 A1 * 11/2001 Vancura ..... 273/274

* cited by examiner

*Primary Examiner*—Jessica J. Harrison
(74) *Attorney, Agent, or Firm*—Marshall, Gerstein & Borun LLP

(57) ABSTRACT

A method of playing a wagering game is disclosed which simulates a knowledge base same. The method electronically selects one of the plurality of questions, displays the electronically selected question to the player in the format of the simulated knowledge base game and displays a plurality of electronically selected answers associated with said electronically selected question to the player in the format of the simulated knowledge base game. The method electronically selects one of the answers associated with the electronically selected question, displays the electronically selected answer to the player in the format of the simulated knowledge base game, displays to the player any value assigned to the electronically selected and presented answer in the format of the simulated knowledge based game and awards to the player the displayed value.

19 Claims, 3 Drawing Sheets

METHOD OF PLAYING A GAME INVOLVING QUESTIONS AND ANSWERS

BACKGROUND OF THE INVENTION

Many enjoyable games involve a player's knowledge of subject matter other than game rules, game odds, and game strategy, such that a player with relevant, superior knowledge obtains an improved possibility of obtaining success in the game. Such games are a type of "skill" game, rather than a game of chance.

A popular board type skill game known as "Trivial Pursuit" involves the use of a playing piece associated with each player that moves about a playing board with several different colored squares comprising potential landing areas. The player's piece is moved a number of squares and lands on a landing area corresponding to the number of black dots face up after the roll of a die. The game also includes a large number of cards, where one surface of the card bears colors corresponding to the colors of the landing spaces, each of which in turn corresponds to a particular category of knowledge, such as sports, geography, history, etc. The same face of the card also includes a question for each color or knowledge category. The reverse side of the card bears corresponding colors and an associated, correct answer to the corresponding question. When a player's playing piece lands on a square of a certain color, another player picks one of the cards, and reads to the player the question on the card corresponding to the color/knowledge category of the landing area. For example if the player's playing piece lands on a colored square corresponding to the history category, the question on the card may be, for example, "Who was the U.S. President who obtained the largest percentage margin of victory in a Presidential election since 1900?" If the player correctly answers the question, then the player continues his turn, otherwise the turn passes to another player. Without elaborating further on the details of the rules of play of the Trivial Pursuit game, it is to the player's advantage to correctly answer the question and to continue play.

Another popular skill game broadcast by television is known as "Jeopardy". This game utilizes a number of statements arranged in a rectangular array, with the columns of the array representing different subject matters, such as American history, silent films, baseball, etc., and the rows indicating different monetary values, such as $50, $100, etc. Initially the players do not see the statements, and when a player has a turn, the player may select a statement by designating the column and row, such as "American history for $100". The statement would then be revealed, for example, "He was the first of the first pair of Presidents having the same last name", and the player would then respond with a question, "Who was John Adams?" for the correct response or "Who was Joe Jones?" for an incorrect response. If a player responds incorrectly, then the player loses a turn, however, if the player responds correctly, then the player is awarded the monetary value associated with the statement. It will be appreciated that although the Jeopardy game presents a statement, and asks a player to respond with the proper question, in essence, the statement is really a question and the response is really an answer. Other details of the Jeopardy game are believed to be immaterial to the instant application, but suffice it to say that by responding correctly, a player achieves greater success in the game.

In yet another popular skill game broadcast by television known as "Who Wants to Be A Millionaire", a contestant or player is sequentially asked a series of questions and then usually given four multiple choice potential answers to each question, one of which is the correct answer. For each question, the player is awarded an increasing amount of money for choosing the correct answer. Usually the questions and potential answers presented later in the sequence are more difficult to correctly answer than those presented earlier in the sequence. Again, other details of the game are believed to be immaterial, however, the player's knowledge or skill permits the player to have a better chance of success in playing the game.

In yet another popular televised skill game known as "Family Feud", a team of players or contestants is presented with a question such as "name things that crawl", and then the team must answer the question with what the team thinks are the most frequent answers previously given by a group of people. Usually, the game requires the team to give answers that correctly identify the most frequent three, four, or five answers before the team gives three answers that are not in the most frequent three, four, or five answers. The team is awarded points for its answers that correspond with the most frequent answers given by the group. Other details respecting this game are not material to this background discussion, but again, the knowledge or skill of the players on the team enhances the team's possibility of success in the game.

Skill games such as those described above are not readily adaptable to a wagering type of game, such as a casino game in which players play against the casino or house. If the house sets a standard of achievement of the game such as a certain number of correct answers that must be achieved in order to win, then many unskilled players will lose at the game, some so often that they refuse to continue playing the game. On the other hand, some players may be so skilled that they consistently achieve the standard and win more than they lose, thus "beating the house". The relatively highly knowledgeable or skilled players would thus play the game to their profit and to the casino's or house's unprofitability.

Virtually all casino wagering games constitute games of chance, rather than skill, with the odds always slightly in the casino's or house's favor. Thus, over a large number of players, or over a long length of play by a single player, the house will achieve a profit.

The present invention generally relates to methods of playing games, such as wagering, casino games, that involve questions and answers and which, for example, adapt the foregoing types of games into games of chance, and not skill, for play in a casino environment.

SUMMARY OF THE INVENTION

The present invention relates to a method of playing a game of chance that presents a player with a question and potentially displays a group of answers, at least one of which is a desirable answer.

BRIEF DESCRIPTION OF THE DRAWINGS

The present invention will be described with reference to the accompanying drawings wherein like reference numerals refer to the same item.

DETAILED DESCRIPTION OF THE PREFERRED EMBODIMENTS

Figure 1:
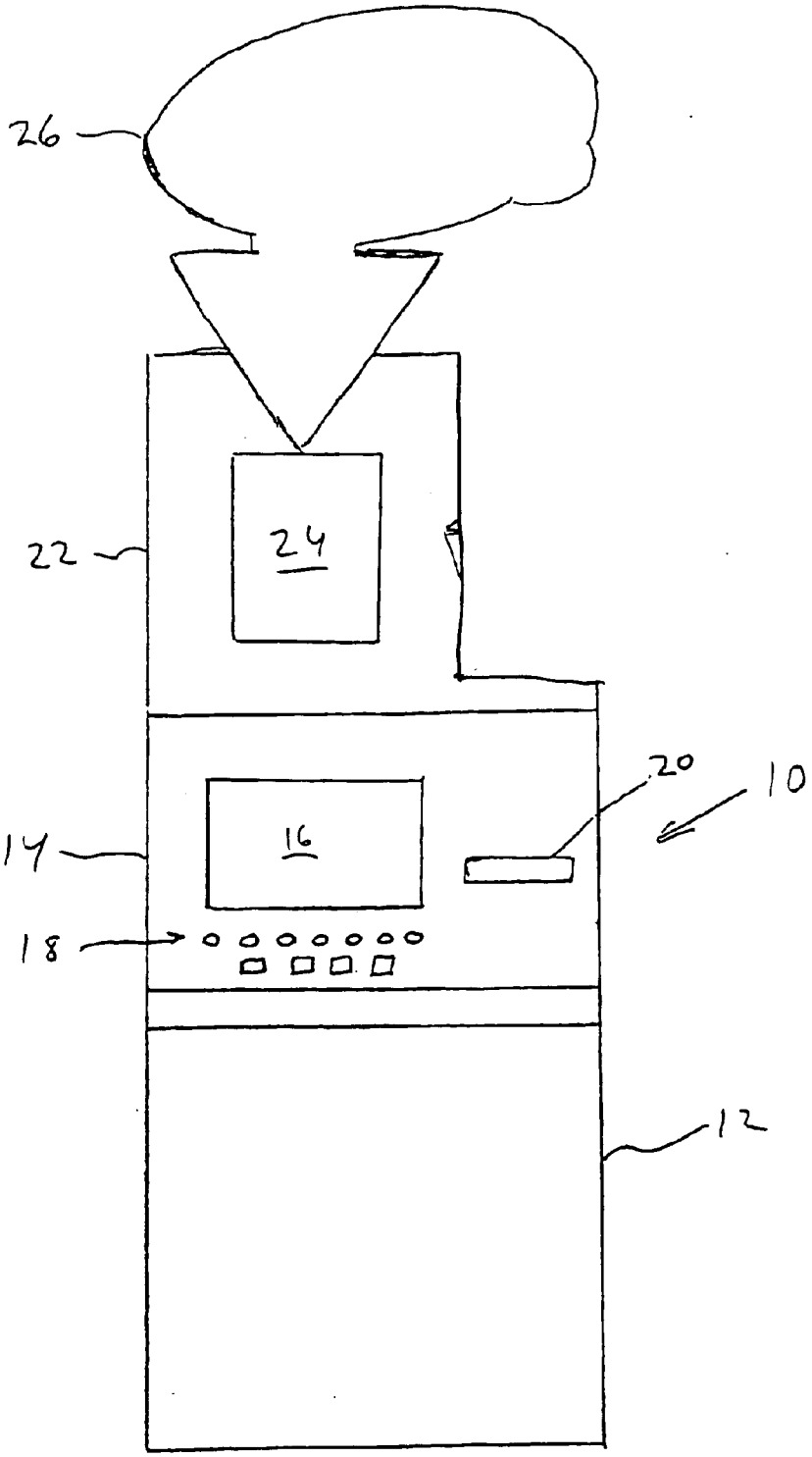
FIG. 1 is a front view of a casino video game machine that may be used in connection with the instant invention.

There is shown in FIG. 1 a casino video game machine 10 generally fashioned as a "slant top" machine in which a player usually sits on a stool or chair in front of the machine 10. It should be appreciated from a further reading of the preferred embodiment that the instant invention may be employed with a wide variety of games, however, such as "upright", stand alone video game machines and such as games played with a computer monitor and keyboard.

The machine 10 includes a generally boxed shaped base 12 that house electronics and other equipment used in the operation of the game. The machine 10 also includes a slanted section 14 that contains a main game video monitor 16, a series of game control buttons 18 (although the invention contemplates that touch screen, light pen, track ball, mouse, and other game control facilities may be utilized), and monetary acceptance devices 20, such as a bill validator, a coin comparator, and an electronic funds transfer device. The machine 10 also includes an upper display section 22 that may contain graphic displays, lights, and a second video monitor 24. A display sign 26 may be mounted on top of the machine 10.

A preferred embodiment of the present invention relating to an adaption of the Family Feud game will now be described with reference to the casino video game machine 10 as shown in FIG. 1. The Family Feud variant game may be played as a basic casino game, or as an adjunct bonus, secondary event feature to a different type of casino game, such as a video poker game or a video slot game. Prior to the play of the Family Feud game variant, a large number of questions are posed to a group of people, perhaps as many as 100 people. Each person in the group is then asked to provide a single answer to the question. The answers of the group are tallied to determine how many times each particular, different answer was provided. For example, in response to the question, "name something that crawls", the tally may be:

| | |
|---|---|
| "baby" | 21 times |
| "spider" | 17 times |
| "snake" | 16 times |
| "worm" | 14 times |
| "snail" | 8 times |
| "ant" | 4 times |
| "centipede" | 3 times |
| "vine" | 3 times |
| many other answers | 2 and 1 times |

For another example in response to the question, "name things that are usually on a restaurant table", the tally might be as follows:

| | |
|---|---|
| "napkin" | 14 times |
| "salt and pepper shaker" | 13 times |
| "water glass" | 10 times |
| "silverware" | 8 times |
| "ketchup" | 6 times |
| "sugar" | 5 times |
| "ashtray" | 4 times |
| a number of other answers | 3, 2, and 1 times |

The answer having the highest frequency for each question will receive the highest ranking, the next most frequent answer will receive the next highest ranking, etc. A value will then be assigned to each ranking, with the highest value associated with the highest ranking, the next highest value associated with the next highest ranking, etc. The value may be a fixed monetary value, or may be a multiple of the wagered amount, or may be some other type of award or prize.

An electronic database is then prepared of all of the questions and the corresponding groups of the associated answers. The group of associated answers may be any number, but preferably is in the range of six to nine. Of the six to nine most frequent answers, the three least frequent answers will be designated "incorrect" or "undesirable" answers, and the remaining answers will be deemed "correct" or "desirable" answers. It should be appreciated that the three undesirable answers need not even be answers given by any of the persons in the group of persons to whom the question was posed. However, it is believed that the play of the game will be more exciting if the undesirable answers consist of the next most frequent answers given by the group. The database will also include the value assigned to each desirable answer.

Figure 2:
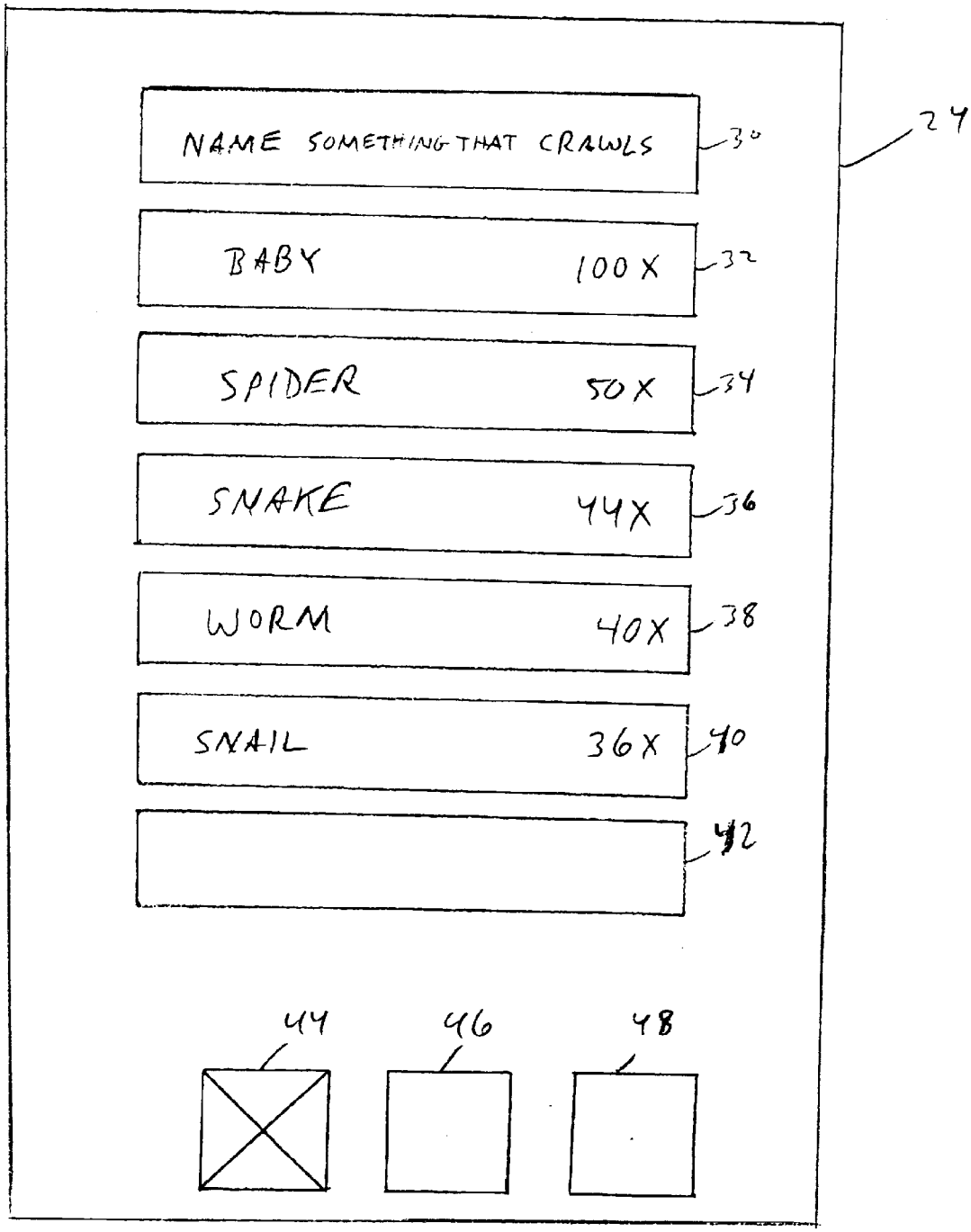
FIG. 2 is a schematic illustration of a video screen of the casino video game machine as shown in FIG. 1.

The player begins play of the Family Feud variant by pressing a designated game control button 18, which will cause a series of rectangular displays 30, 32, 34, 36, 38, 40, 42, 44, 46, 48 to appear in the second video monitor 24. The activation of the designated game control button 18 causes a microprocessor to randomly select from the database one of the questions and to display that question in the top-most rectangular display 30. As shown in FIG. 2 the question reads, for example, "name something that crawls." Simultaneously with a display of the question in the top-most rectangular display 30, a number of the rectangular displays therebelow will be illuminated in a white color, which number corresponds to the number of "correct" or "desirable" answers. Any remaining rectangular displays beneath the top-most rectangular display 30, will remain dark or in a black color.

After the question is displayed in the top-most rectangular display 30 and a number of other rectangular displays are illuminated in white, which number corresponds with the number of "desirable" answers associated with the question, then the player presses another game control button 18 which activates a microprocessor to randomly select from the database one of the desirable or undesirable answers associated with the question displayed in the top-most rectangular display 30. In the example shown in FIG. 2, there are five "desirable" answers consisting of the five most frequent answers, and there are three undesirable answers consisting of the three next most frequent answers. The microprocessor will also assess the ranking and any value of the randomly selected answer. If the desirable answer is the most frequent answer, then the microprocessor will display the answer and associated value in the rectangular display 32 immediately beneath the top-most rectangular display 30. If the microprocessor determines that the randomly selected desirable answer is the second most frequent answer and has the second highest ranking in value, then the microprocessor will display the answer and the associated value in the rectangular display 34, etc. After the microprocessor has displayed the randomly selected answer in the appropriate rectangular display, then the player again presses a designated game control button 18 to cause the microprocessor to select another remaining one of the desirable and undesirable answers associated with the question. If the answer is undesirable, then the microprocessor will display the answer in the main game video monitor 16, and will display an "X" symbol in the left-most one of three display boxes 44, 46, 48 appealing across the bottom of the main game video monitor 16, as shown in FIG. 2. If the microprocessor later selects additional undesirable answers, then the microprocessor will place an X in the middle display box 46, and any further undesirable answer will result in the microprocessor displaying an "X" in the right-most display box 48.

As a desirable answer is displayed, the microprocessor may cause the video game machine 10 to emit a bell like sound associated with joy and winning, and if the microprocessor displays an undesirable answer, then the microprocessor may cause the casino video game machine 10 to emit a buzzer like sound associated with depression or losing. It should be readily apparent that those skilled in the art that other types of sounds or visual displays may be initiated in response to the display of a desirable answer or an undesirable answer.

The play proceeds in a likewise manner with a player pressing a designated player control button 18 until the microprocessor has selected all of the desirable answers, or until the microprocessor has selected three undesirable answers, whereupon the game ends.

A hypothetical scenario that may result in the display as shown in FIG. 2 is as follows. When the game begins, the microprocessor selects the question "name something that crawls" and displays the question in the top most rectangular display 30. The player then presses another designated game control button 18 and a desired answer "snake" and an associated value "44X" appear in the rectangular display 36. The player then again presses the other designated game control button 18, and another desired answer "worm" and an associated value "40X" appear in the rectangular display 38. The player then depresses the other designated game control button 18 and the undesirable answer "ant" is displayed in the main game video monitor 16, and an "X" is placed in the left most display box 44. The player again depresses the button, and the desirable answer "snail" and the associated value "36X" is displayed in the rectangular display 40. The player again depresses the button, and the desirable answer "baby" and the associated value "100X" appear in the rectangular display 32. The player again depresses the button, and the desirable answer "spider" and the associated value "50X" appear in the rectangular display 34. At this juncture the game is over since the player has achieved all five desirable answers before obtaining three undesirable answers.

When the game is over, either by the player achieving three undesirable answers, or by achieving all of the desirable answers, the value of the displayed desirable answers is totaled. In the example as shown in FIG. 2, the total value is "270X". Such a value would indicate that the player is entitled to receive an award equal to 270 times the value of the player's wager.

When the game is played as a bonus or secondary event feature to an underlying casino video game, then the game may award the player a minimum amount, even when the player has achieved three undesirable answers without having obtained any desirable answers.

In a further variation of the above described Family Feud variant, the microprocessor may select a plurality of questions, preferably three to five questions, from the data base of questions and may display the selected plurality of questions in the second video monitor 24. The questions may be randomly selected from the database or sequentially selected from a prescribed ordering of the questions in the database. When the questions are displayed, the player may select a desired one of the displayed questions to use in the play of the game by pressing a designated control button 18. Such a variation feature permits a player to have some control over the game and to choose a question that will generate more interest or excitement for the player. Nevertheless, as will be appreciated from the description below, the average payback is essentially the same from question to question, and therefore, the player gains no appreciable advantage resulting from the question selection process.

The instant invention may be adapted for playing a Jeopardy variant as follows. For each question, there is a single correct, "desirable" answer; and one or more predetermined incorrect, "undesirable" answers may be provided. Both the desirable and undesirable answers may be placed in a database. The player may press a designated game control button 18, which activates the microprocessor to randomly select a question from the database and to display the question. The player then presses a different designated game control button 18 which activates the microprocessor to select one of the desirable and undesirable answers associated with the displayed question. The player continues this process until the player has achieved either a predetermined number of undesirable answers or has obtained the desirable answer. The answers may be displayed on the second video monitor 24. The display of the desired answer will also display an associated value, such as 75X or $75. If the player obtains the preselected number of undesirable answers prior to obtaining the desired answer, then the player will receive no award, or if the game is being played as a bonus, second event feature to a basic casino video game, then the player may be awarded a minimum amount.

In the Jeopardy game variant, the value associated with the correct answer may be determined slightly differently from the values of the correct answers in the Family Feud game variant. Prior to the play of the Jeopardy game variant, a large number of questions are posed to a group of people, perhaps as many as 100 people. Each person in the group is then asked to provide a single answer to the question. For example, the question may be "He was the first of the first pair of Presidents having the same last name", and 45 of the persons in the group of 100 persons correctly answered, "Who was John Adams?". The same group would then be asked a different question, for example, "He starred in the movie *Gone With the Wind*", and 58 of the persons in the group of 100 persons correctly responded, "Who was Clark Gable?". Other questions are proposed to the group, and the number of correct answers tallied for each question. Questions with the most number of correct answers would be given a lesser value than the questions having a fewer number of correct answers. In essence, the harder the question/answer, then the correct answer would be more valuable. Where a game has one correct answer, then the value of the answer may be portrayed as the value of the question and the same are equivalent.

It should be appreciated that the "Trivial Pursuit" and the "Who Wants to Be A Millionaire?" games may be presented as variants similar to that described with reference to the Jeopardy game.

As an alternative to displaying the answers sequentially on a screen, the answers may be presented on the periphery of a virtual reel or cylinder that may be virtually spinning and may randomly stop at a selected location. Also alternatively, the answers may each be presented in pie shaped segments of a virtual disc or wheel, with either the disc virtually spinning or an arrow above the wheel virtually spinning, and randomly stopping at a particular answer. In these latter two alternative embodiments, the player may depress a game control button 18 that initiates the spinning of the reel, wheel, or arrow, and a microprocessor may randomly stop the reel, wheel, or arrow at a location indicating the answer.

Where the value of a correct answer is a multiple of a wager, and the game is played as an adjunct bonus, secondary feature to a basic casino game, the wager to be multiplied in value may be determined as follows. The wager to be multiplied may be based upon the total amount wagered for the basic game. For example, a player of a slot machine may be given the option of placing one, two, three, or four quarters in the machine before spinning the reels. If the reels achieve a bonus situation enabling the player to play the Family Feud variant described above, then value of the player's winnings in the Family Feud variant will be a multiple of the total value of the quarters the player placed in the slot machine prior to the spin which achieved the bonus condition. As another alternative, for example, in a Multi-Draw poker game, the player is given the option of playing up to five rows of five card hands of draw poker and is given the further option of designating how much to wager for each of the rows. If a hand in one of the rows achieves a bonus condition (such as four of a kind) and the player is entitled to play the Family Feud variant described above, then the winnings of the Family Feud variant will be a multiple of the wager associated with the row containing the hand that achieved the bonus condition. In yet another alternative embodiment, the player may play a basic casino game of a five reel slot machine containing nine paylines. A bonus condition may be achieved by a bonus symbol appearing on three reels of a payline. If the player is then entitled to play the Family Feud variant described above, then any winnings may be a multiple of the wager associated with the payline containing the three winning symbols. If, as a further example, the player achieved four bonus symbols on the same payline, or five bonus symbols on the same payline, then the value achieved in the Family Feud variant may be doubled or tripled, respectively.

In order to ensure that the house or casino does not lose money during play of the variant games described above, the "payback" to the player must be statistically calculated. When the variant game is played as an adjunct bonus, secondary event feature to a basic casino game, then the "payback" is calculated by further determining the average amount won in the bonus as well as the frequency of the bonus condition being achieved in the basic game. In the Family Feud variant, it is possible to devise the payback so that the average payback per question is substantially constant. In the Jeopardy variant discussed above, if different values are assigned based upon the difficulty of the question/answer, then the payback should be averaged over a large number of questions or at least the number of questions contained in the database. As a very simple example of calculating the payback for a Jeopardy variant, presume that there are three questions and a single desirable answer for each question, one of which has a value of 30 times the amount of the wager, another of which has a value of 22 times the value of the wager, and a third one of which has a value of 20 times the value of the wager. Further assume that the odds of obtaining the correct answer are one in three. The average payback would be eight times the value of the wager.

In a further variant of the Jeopardy game, the microprocessor may display on the second video monitor a plurality of different values, preferably three or four values, such as 40×, 25×, and 10×. The player may then select one of the values by pressing a designated game control button 18, and the microprocessor will then select a question from the database that has an associated value equal or substantially equal to the displayed value selected by the player. The microprocessor may select the question randomly from questions having such value in the database or sequentially from a prescribed order of such questions in the database. Since the odds of a player obtaining a correct answer multiplied by the value of the question may be essentially constant from question to question, such a feature permits a player the opportunity to play more aggressively (assuming a greater risk for a higher award) or more conservatively (taking a lower risk for a lower award) even though average award remains essentially constant regardless of the value selected.

Figure 3:
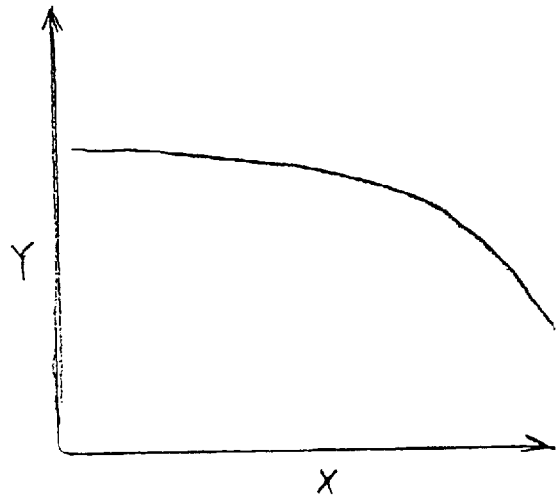
FIGS. 3, 4 and 5 illustrate different base curves that may be used in determining a payback for the instant invention.
Figure 4:
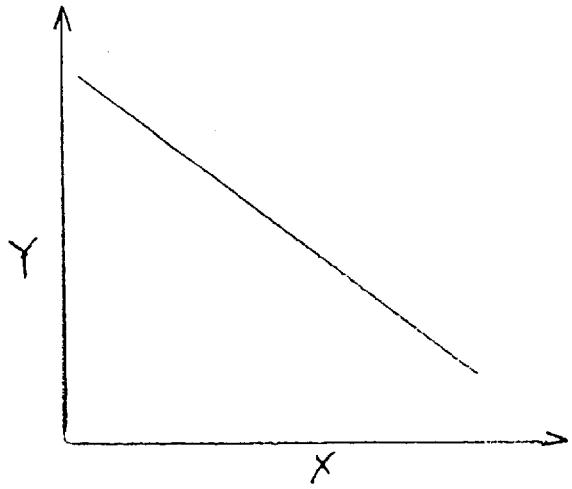

A more sophisticated system for calculating the value of awards in a Family Feud variant uses a modeling system for determining the value associated with the desirable answers. In one modeling system utilizing the curves shown in FIGS. 3, 4, and 5, the "X" axis represents the ranking of the answers based upon the frequency with which the answers are given, and the "Y" axis represents the number of times each answer was given. The curve shown in FIG. 3 depicts a scenario where the most frequently given answers were given almost the same number of times, for example, the most frequently given answer was given 20 times, the next most frequent answer was given 19 times, and the third most frequent answer was given 18 times. The curve shown in FIG. 4 depicts a scenario where the most frequently given answers were given a fairly constantly descending number of times, for example, the most frequent answer was given 24 times, the next most frequent answer was given 20 times, and the third most frequent answer was given 16 times. Lastly, the curve in FIG. 5 illustrates a scenario in which the most frequent answer was given a disproportionately large number of times compared with the second, third, and fourth most frequent answers.

It is believed that psychologically a player may sense how one desirable answer compares with other desirable answers, that is, how frequently the desirable answer might be given by a group of persons compared with the frequency with which a different desirable answer is given by the group. Accordingly, it is believed that a player should be given relatively more value for achieving a desirable answer that obtained a disproportionately large frequency of answers from the group.

Figure 5:
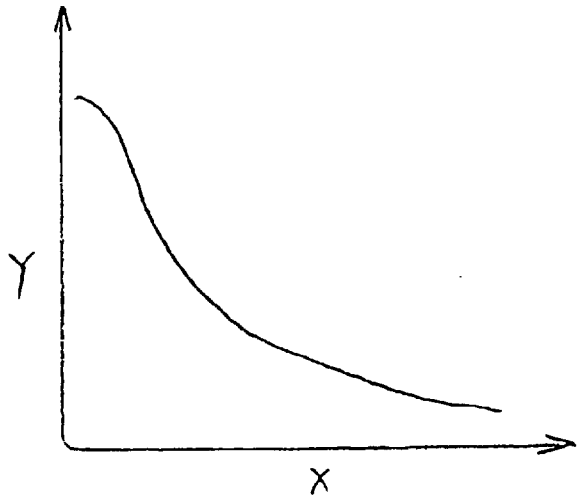

The following tables show how the curves depicted in FIG. 3, 4, and 5 may be implemented in modeling a Family Feud variant where the number of correct answers is either three, four, five, or six, and the number of undesirable answers is consistently three. In the following table, "Strike Out" means that the player did not obtain all of the desirable answers before obtaining the three undesirable answers, and the term "Expected Number of Picks" means the average total of desirable and undesirable answers that the player can expect to obtain during one round of play before either achieving all of the desirable answers or obtaining three undesirable answers.

| Table Number | Number Correct Answers | Minimum Award | Maximum Award | Average Award Value | P(Get All Correct Answers) | P(Get No Correct Answers) | P(Strike Out) | Expected Number of Picks |
|---|---|---|---|---|---|---|---|---|
| 1 | 3 | 10 | 150 | 113.00 | 50.00% | 5.00% | 50.00% | 4.50 |
| 2 | 3 | 10 | 150 | 113.00 | 50.00% | 5.00% | 50.00% | 4.50 |
| 3 | 3 | 10 | 150 | 113.00 | 50.00% | 5.00% | 50.00% | 4.50 |
| 4 | 4 | 10 | 150 | 112.79 | 42.86% | 2.86% | 57.14% | 5.40 |
| 5 | 4 | 10 | 150 | 112.79 | 42.86% | 2.86% | 57.14% | 5.40 |
| 6 | 4 | 10 | 150 | 112.79 | 42.86% | 2.86% | 57.14% | 5.40 |
| 7 | 5 | 10 | 150 | 112.68 | 37.50% | 1.79% | 62.50% | 6.25 |
| 8 | 5 | 10 | 150 | 112.68 | 37.50% | 1.79% | 52.50% | 6.25 |
| 9 | 5 | 10 | 150 | 112.68 | 37.50% | 1.79% | 62.50% | 6.25 |
| 10 | 6 | 10 | 150 | 112.62 | 33.33% | 1.19% | 66.67% | 7.07 |
| 11 | 6 | 10 | 150 | 112.62 | 33.33% | 1.19% | 66.67% | 7.07 |
| 12 | 6 | 10 | 150 | 112.62 | 33.33% | 1.19% | 66.67% | 7.07 |
| Averages: | 4.50 | 30.00 | 150.00 | 112.77 | 40.92% | 2.71% | 59.08% | 5.81 |

Note that the Average Award Value is fairly constant.

The following four tables were used to create the Average Value Award in the foregoing table, using the curves illustrated in FIGS. 3, 4, 5. In the following tables, tables 1, 4, 7, and 10 illustrate the values in a scenario such as that shown in FIG. 3; tables 2, 5, 8, and 11 illustrate the scenario depicted in the illustration in FIG. 4, and tables 3, 6, 9, and 12 illustrate the scenario shown in FIG 5.

For Tables 1, 2, and 3 which all have 3 correct answers.

| Answer Number | Table 1 | Table 2 | Table 3 |
|---|---|---|---|
| 1 | 65 | 75 | 80 |
| 2 | 55 | 50 | 45 |
| 3 | 30 | 25 | 25 |
| 4 | — | — | — |
| 5 | — | — | — |
| 6 | — | — | — |
| Consolation | 10 | 10 | 10 |

For Tables 4, 5, and 6 which all have 4 correct answers.

| Answer Number | Table 4 | Table 5 | Table 6 |
|---|---|---|---|
| 1 | 45 | 55 | 70 |
| 2 | 40 | 45 | 35 |
| 3 | 35 | 30 | 25 |
| 4 | 30 | 20 | 20 |
| 5 | — | — | — |
| 6 | — | — | — |
| Consolation | 10 | 10 | 10 |

For Tables 7, 8, and 9 which all have 5 correct answers.

| Answer Number | Table 7 | Table 8 | Table 9 |
|---|---|---|---|
| 1 | 45 | 50 | 60 |
| 2 | 40 | 35 | 30 |
| 3 | 30 | 30 | 25 |
| 4 | 20 | 20 | 20 |
| 5 | 15 | 15 | 15 |
| 6 | — | — | — |
| Consolation | 10 | 10 | 10 |

For Tables 10, 11, and 12 which all have 6 correct answers.

| Answer Number | Table 10 | Table 11 | Table 12 |
|---|---|---|---|
| 1 | 40 | 40 | 50 |
| 2 | 35 | 30 | 25 |
| 3 | 30 | 25 | 22 |
| 4 | 18 | 22 | 20 |
| 5 | 15 | 18 | 18 |
| 6 | 12 | 15 | 15 |
| Consolation | 10 | 10 | 10 |

Note that the total values for the desirable answers in each table equal 150.

The base curves shown in FIGS. 3, 4, and 5 are generally depicted, however other curves may also be utilized. Also, there may be slight variations to the curves as shown in FIGS. 3, 4, and 5, and there may be any number of curves utilized. A curve is selected for use in determining a set of values based upon the amount of similarity or deviation of the actual scenario of the frequency of answers from each of the three base curves. The base curve having the closest similarity to the actual scenario is selected for constructing a value table. A very simple way of determining which of the base curves is most similar to the actual scenario is to determine the ratio between the number of times the most frequent answer is given and the number of times the next most frequent answer is given. For example, if the ratio is 1.5 or less, then the curve of FIG. 3 and the values of one of the tables, 1, 4, 7, and 10 are selected; if the ratio is less than 2.5 but greater than 1.5, then the curve of FIG. 4 and the values of one of the tables 2, 5, 8, or 11 are selected; and if the ratio is 2.5 or greater, then the curve of FIG. 5 and the values of one of the one of the tables 3, 6, 9, and 12 are selected.

Although particular embodiments of the present invention have been described and illustrated herein, it should be recognized that modifications and variations may readily occur to those skilled in the art and that such modifications and variations may be made without departing from the spirit and scope of our invention. Consequently, our invention as claimed below may be practiced otherwise than as specifically described above.

What is claimed is:

1. A method of playing a wagering game which simulates a knowledge base game and in which a player of the game may win an award comprising:

providing an electronic database of a plurality of questions for presentation to the player where the questions are separated into a plurality of question groups wherein the question groups offer different potential values to the player and where the question groups with more difficult questions offering higher potential values to the player;

providing an electronic database of a plurality of answers associated with each questions for presentation to the player;

assigning a value to at least one answer;

allowing the player to select the question group;

electronically selecting one of said plurality of questions in the selected question group;

displaying said electronically selected question to the player in the format of the simulated knowledge base game;

displaying a plurality of electronically selected answers associated with said electronically selected question to the player in the format of the simulated knowledge based game;

electronically selecting one of said answers associated with said electronically selected question;

displaying said electronically selected answer to the player in the format of the simulated knowledge base game;

displaying to the player any value assigned to said electronically selected and presented answer in the format of the simulated knowledge based game; and awarding to the player said displayed value wherein the awarded value is independent of the knowledge of the player.

2. A method according to claim 1, wherein one of said plurality of questions is electronically, substantially randomly selected and wherein one of said answers is electronically, substantially randomly selected.

3. A method according to claim 1, wherein displaying a plurality of electronically selected answers associated with said electronically selected question to the player in the format of the simulated knowledge base game further comprises displaying the plurality of electronically selected answers in the periphery of a virtual slot machine reel that spins and wherein displaying said electronically selected answer to the player in the format of the simulated knowledge base game further comprises stopping the virtual slot machine reel to display the selected answer as a displayed element of the virtual reel.

4. A method according to claim 1, wherein displaying a plurality of electronically selected answers associated with said electronically selected question to the player in the format of the simulated knowledge base game further comprises displaying the plurality of electronically selected answers as pie shaped segments on a virtual disc that rotates in relation to a win indicator and wherein displaying said electronically selected answer to the player in the format of the simulated knowledge base game further comprises stopping the rotation of the virtual disc in relation to the win indicator such that the selected answer is displayed in logical proximity to the win indicator.

5. A method of playing a wagering game which simulates a knowledge base game and in which a player of the game may win an award comprising:

providing an electronic database of a plurality of questions for presentation to the player where the questions are separated into a plurality of question groups wherein the question groups offer different potential values to the player and where the question groups with more difficult questions offering higher potential values to the player;

providing an electronic data base of a plurality of answer groups each comprising a plurality of answers associated with one of said questions for presentation to the player, each answer group including at least one desirable answer and at least one undesirable answer;

assigning a value to each desirable answer;

electronically selecting one of said plurality of questions;

displaying said electronically selected question to the player in the format of the simulated knowledge base game;

displaying the answer group associated with said electronically selected question to the player in the format of the simulated knowledge base game;

electronically selecting one of said answers from said answer group associated with said electronically selected question;

displaying said electronically selected answer to the player in the format of the simulated knowledge base game;

displaying to the player any value assigned to said electronically selected and presented answer; and awarding to the player said displayed value wherein the awarded value is independent of the knowledge of the player.

6. A method according to claim 5, wherein each answer group includes a plurality of desirable answers and a plurality of undesirable answers.

7. A method according to claim 5, wherein displaying a plurality of electronically selected answers associated with said electronically selected question to the player in the format of the simulated knowledge base game further comprises displaying the plurality of electronically selected answers in the periphery of a virtual slot machine reel that spins and wherein displaying said electronically selected answer to the player in the format of the simulated knowledge base game further comprises stopping the virtual slot machine reel to display the selected answer as a displayed element of the virtual reel.

8. A method according to claim 5, wherein displaying a plurality of electronically selected answers associated with said electronically selected question to the player in the format of the simulated knowledge base game further comprises displaying the plurality of electronically selected answers as pie shaped segments on a virtual disc that rotates in relation to a win indicator and wherein displaying said electronically selected answer to the player in the format of the simulated knowledge base game further comprises stopping the rotation of the virtual disc in relation to the win indicator such that the selected answer is displayed in logical proximity to the win indicator.

9. A method according to claim 5, wherein one of said plurality of questions is electronically, substantially randomly selected and wherein one of said answers is electronically, substantially randomly selected.

10. A method according to claim 5, wherein said value is obtained substantially by presenting a plurality of questions to a plurality of humans, each question having a single, correct answer, having the humans provide an answer to each question, determining for each question the number of times the correct answer is provided by the humans, ranking each correct answer by the number of times such correct answer is provided relative to the number of times correct answers were provided to other questions, with a higher rank given for a correct answer provided less times than correct answers to other questions, and assigning a value substantially corresponding to said ranking, with a higher value assigned to a higher ranking answer.

11. A method of playing a wagering game which simulates a knowledge base game and in which a player of the game may win an award comprising:

providing an electronic database of a plurality of questions for presentation to the player where the questions are separated into a plurality of question groups wherein the question groups offer different potential values to the player and where the question groups with more difficult questions offering higher potential values to the player;

providing an electronic database of a plurality of answer groups each comprising a plurality of answers associated with one of said questions for presentation to the player, each answer group including at least one desirable answer and a plurality of undesirable answers;

assigning a value to each desirable answer;

electronically selecting one of said plurality of questions;

displaying said electronically selected question to the player in the format of the simulated knowledge base game;

displaying the answer group associated with said electronically selected question to the player in the format of the simulated knowledge base game;

electronically, substantially randomly, successively selecting ones of said answers from said answer group associated with said electronically selected question until either a preselected number of undesirable answers are electronically selected or until a preselected number of desirable answers are electronically selected;

displaying said electronically selected answer or answers to the player in the format of the simulated knowledge base game; and awarding to the player the aggregate, total value of each value assigned to each said electronically selected and presented desirable answers wherein the awarded value is independent of the knowledge of the player.

12. A method according to claim 11, wherein displaying a plurality of electronically selected answers associated with said electronically selected question to the player in the format of the simulated knowledge base game further comprises displaying the plurality of electronically selected answers in the periphery of a virtual slot machine reel that spins and wherein displaying said electronically selected answer to the player in the format of the simulated knowledge base game further comprises stopping the virtual slot machine reel to display the selected answer as a displayed element of the virtual reel.

13. A method according to claim 11, wherein displaying a plurality of electronically selected answers associated with said electronically selected question to the player in the format of the simulated knowledge base game further comprises displaying the plurality of electronically selected answers as pie shaped segments on a virtual disc that rotates in relation to a win indicator and wherein displaying said electronically selected answer to the player in the format of the simulated knowledge base game further comprises stopping the rotation of the virtual disc in relation to the win indicator such that the selected answer is displayed in logical proximity to the win indicator.

14. A method according to claim 11, wherein the number of undesirable answers in each answer group is at least three.

15. A method according to claim 11, wherein the number of undesirable answers in each answer group is at least three and wherein said preselected number of undesirable answers is three.

16. A method according to claim 11, wherein the number of desirable answers in each answer group is three, four, five or six.

17. A method according to claim 11, further comprising:

assigning a value to each question and the associated desirable answer, such value selected from a plurality of different values;

displaying at least two of said different values to the player in the format of the simulated knowledge base game; and awarding to the player said selected value if said electronically selected and displayed answer is the desirable answer associated with said selected and presented question.

18. A method according to claim 11, further comprising substantially randomly, successively selecting ones of said answers from said answer group associated with said electronically selected question until either a pre-selected number of undesirable answers are electronically selected or until said desirable answer is electronically selected.

19. A method according to claim 11, further comprising awarding to the player said selected value if said desirable answer is selected before a preselected number of undesirable answers are selected.

* * * * *

UNITED STATES PATENT AND TRADEMARK OFFICE

CERTIFICATE OF CORRECTION

PATENT NO. : 6,863,606 B1
DATED : March 8, 2005
INVENTOR(S) : Charles R. Berg et al.

It is certified that error appears in the above-identified patent and that said Letters Patent is hereby corrected as shown below:

Title page,
Item [76], Inventors, "1139 Amarillo Ave., #1, Palo A lot, CA (US) 94303" should be -- 1523 46th Ave., San Francisco, CA (US) 94122 --.
Item [57], ABSTRACT,
Line 2, "same." should be -- game. --

Signed and Sealed this

Nineteenth Day of July, 2005

JON W. DUDAS
*Director of the United States Patent and Trademark Office*